US011905971B2

(12) United States Patent
Oh

(10) Patent No.: US 11,905,971 B2
(45) Date of Patent: Feb. 20, 2024

(54) WATER PUMP WITH COOLANT FLOW PATH

(71) Applicants: Hyundai Motor Company, Seoul (KR); Kia Corporation, Seoul (KR)

(72) Inventor: Young June Oh, Yongin-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 18/181,735

(22) Filed: Mar. 10, 2023

(65) Prior Publication Data

US 2024/0018973 A1 Jan. 18, 2024

(30) Foreign Application Priority Data

Jul. 18, 2022 (KR) ..... 10-2022-0087940

(51) Int. Cl.

| | |
|---|---|
| ***F04D 29/58*** | (2006.01) |
| ***F04D 3/00*** | (2006.01) |
| ***F04D 29/04*** | (2006.01) |
| ***F04D 29/046*** | (2006.01) |
| ***F04D 29/40*** | (2006.01) |

(52) U.S. Cl.

CPC ..... *F04D 29/586* (2013.01); *F04D 3/00* (2013.01); *F04D 29/046* (2013.01); *F04D 29/406* (2013.01)

(58) Field of Classification Search

CPC ..... F04D 3/00; F04D 29/586; F04D 29/046; F04D 29/406; F04D 29/426; F04D 29/026; F04D 29/628; F04D 29/669; F04D 29/043; F04D 29/086; F04D 29/605; F04D 29/007; F04D 29/061; F04D 29/181; F04D 29/708; F04D 29/106; F04D 29/528; F04D 29/22; F04D 29/4293; F04D 29/445; F04D 29/126; F04D 29/18; F04D 29/548; F04D 29/44; F04D 29/466; F04D 29/648; F04D 29/522; F04D 29/403; F04D 29/582; F04D 13/024; F04D 13/0646; F04D 13/086; F04D 13/08; F04D 13/06; F04D 1/00

See application file for complete search history.

(56) References Cited

U.S. PATENT DOCUMENTS 2,319,730 A * 5/1943 Garraway ..... F04D 13/0646 417/357
10,267,315 B2 * 4/2019 Chalmers ..... F04D 29/5806
(Continued)

FOREIGN PATENT DOCUMENTS

CN 201747626 U 2/2011
CN 210660599 U 6/2020
(Continued)

*Primary Examiner* — Shafiq Mian
*Assistant Examiner* — Dapinder Singh
(74) *Attorney, Agent, or Firm* — Fish & Richardson P.C.

(57) ABSTRACT

A water pump having a coolant flow path includes a stator disposed in a housing, a rotor surrounded by the stator, a shaft disposed in a flow path of the rotor, a first blade connected to the shaft, a first pipe spaced apart from an inner wall of the rotor defining the flow path to define a coolant inlet, a second pipe spaced apart from the inner wall to define a coolant outlet, and a second blade connected to the shaft and disposed in the first pipe or the second pipe.

16 Claims, 7 Drawing Sheets

(56) References Cited

U.S. PATENT DOCUMENTS

| | | | | |
|---|---|---|---|---|
| 2001/0009645 | A1* | 7/2001 | Noda | A61M 60/10 417/420 |
| 2004/0234395 | A1* | 11/2004 | Hatano | F04D 13/0673 417/423.1 |
| 2008/0038122 | A1* | 2/2008 | Kikuchi | F04D 19/002 417/355 |
| 2020/0256348 | A1 | 8/2020 | Hoehn | |

FOREIGN PATENT DOCUMENTS

| | | | |
|---|---|---|---|
| EP | 0903835 | A | 3/1999 |
| JP | 2015061978 | A | 4/2015 |
| KR | 19990081634 | A | 11/1999 |

* cited by examiner

[FIG. 1]
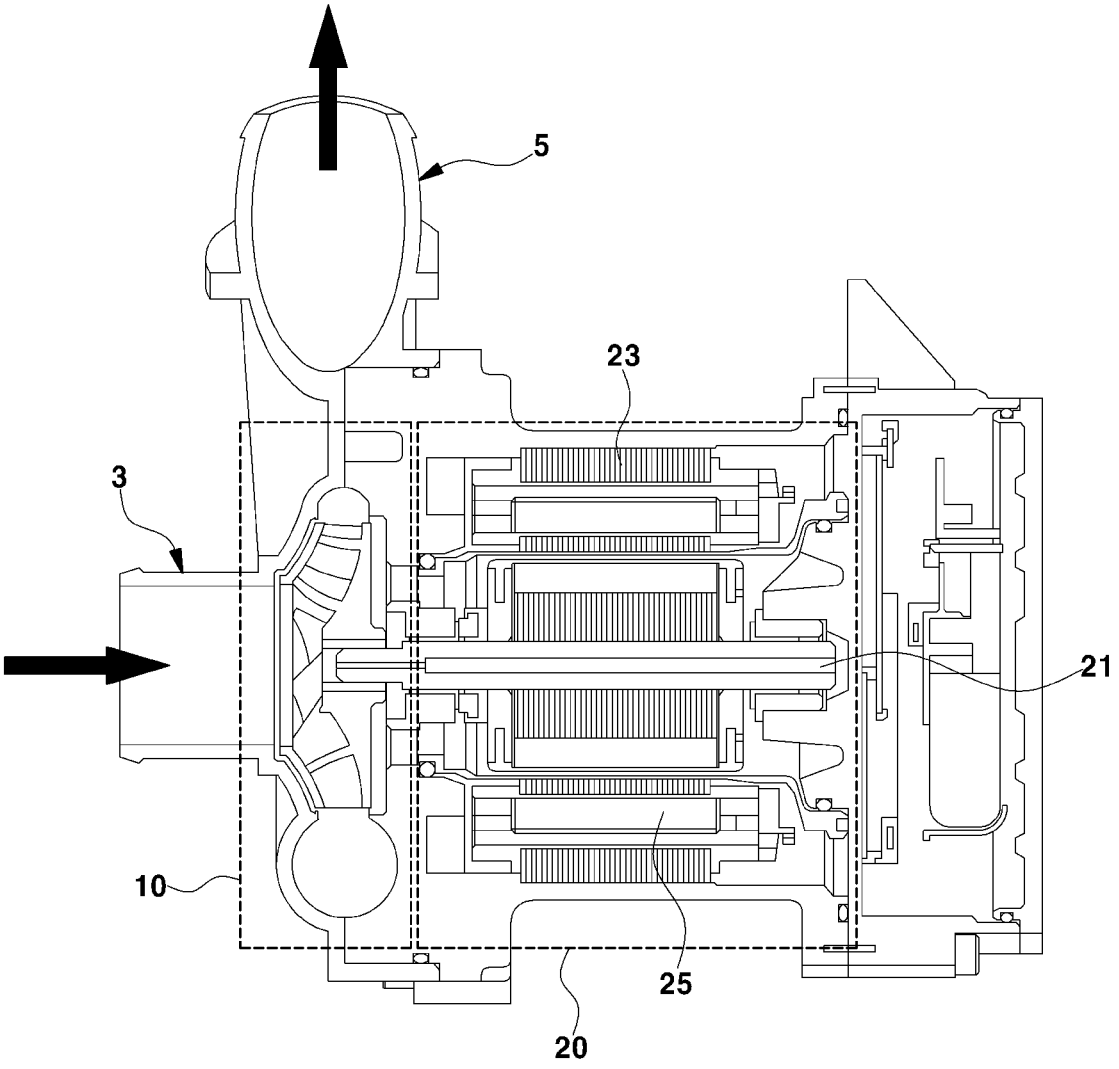

[FIG. 2]
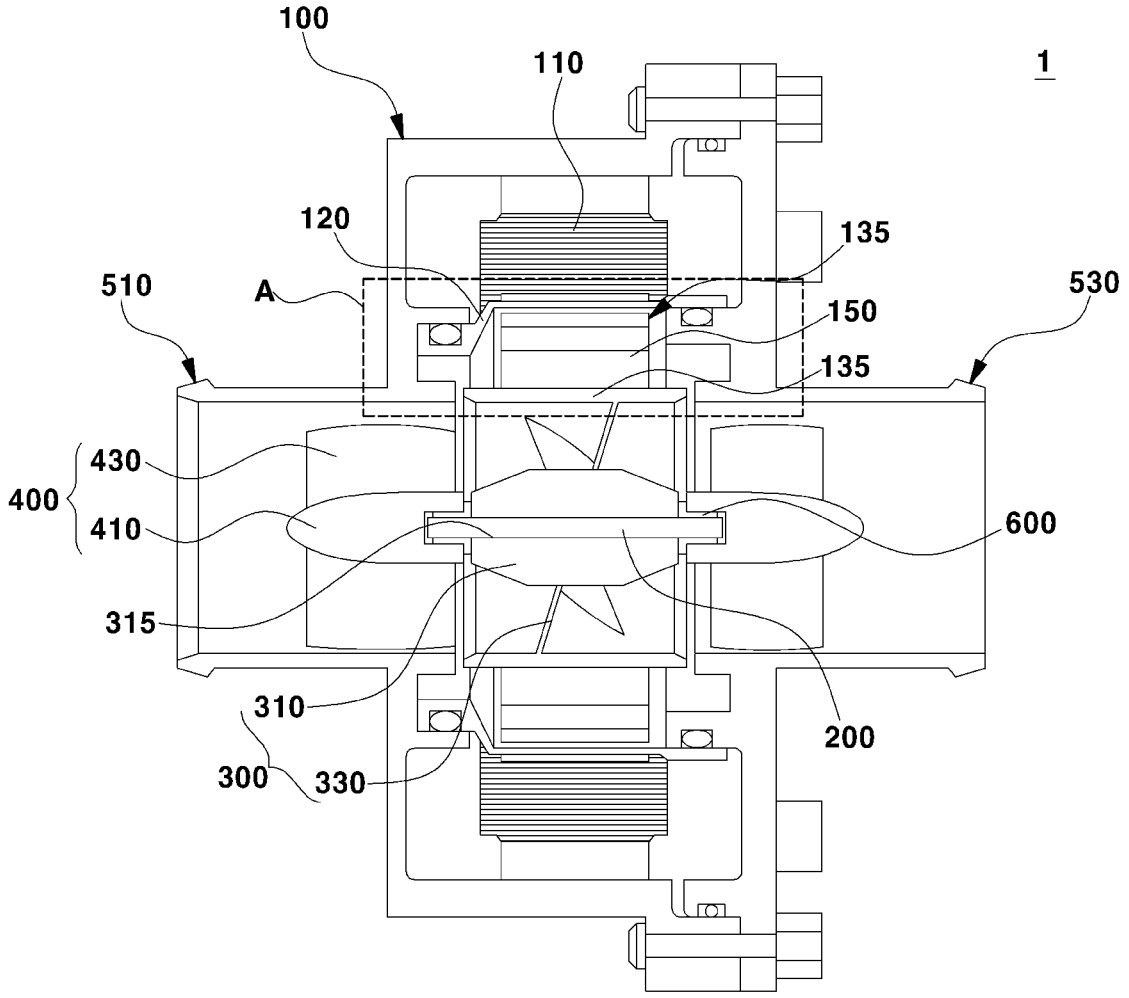

[FIG. 3]
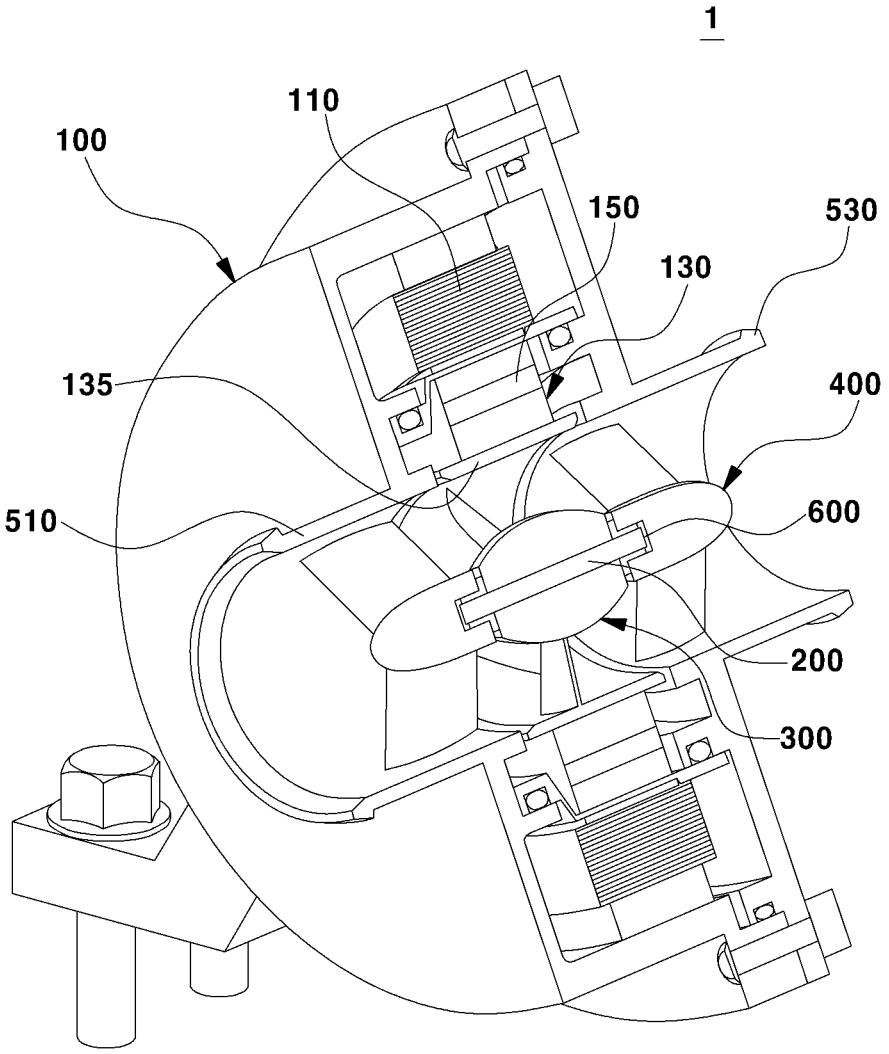

[FIG. 4]
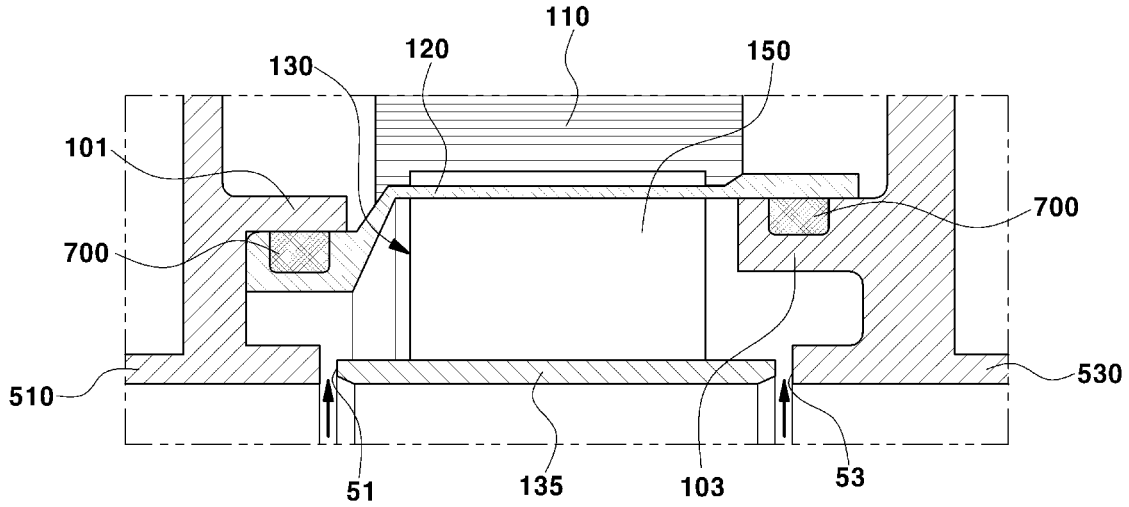
[FIG. 5]
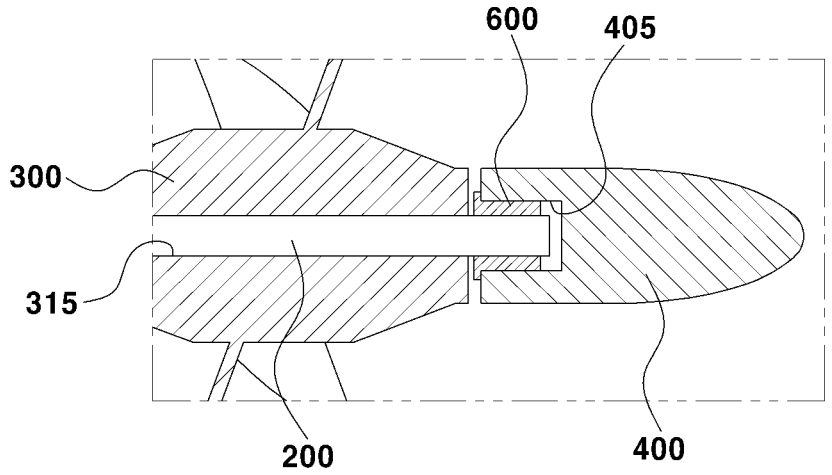

[FIG. 6]
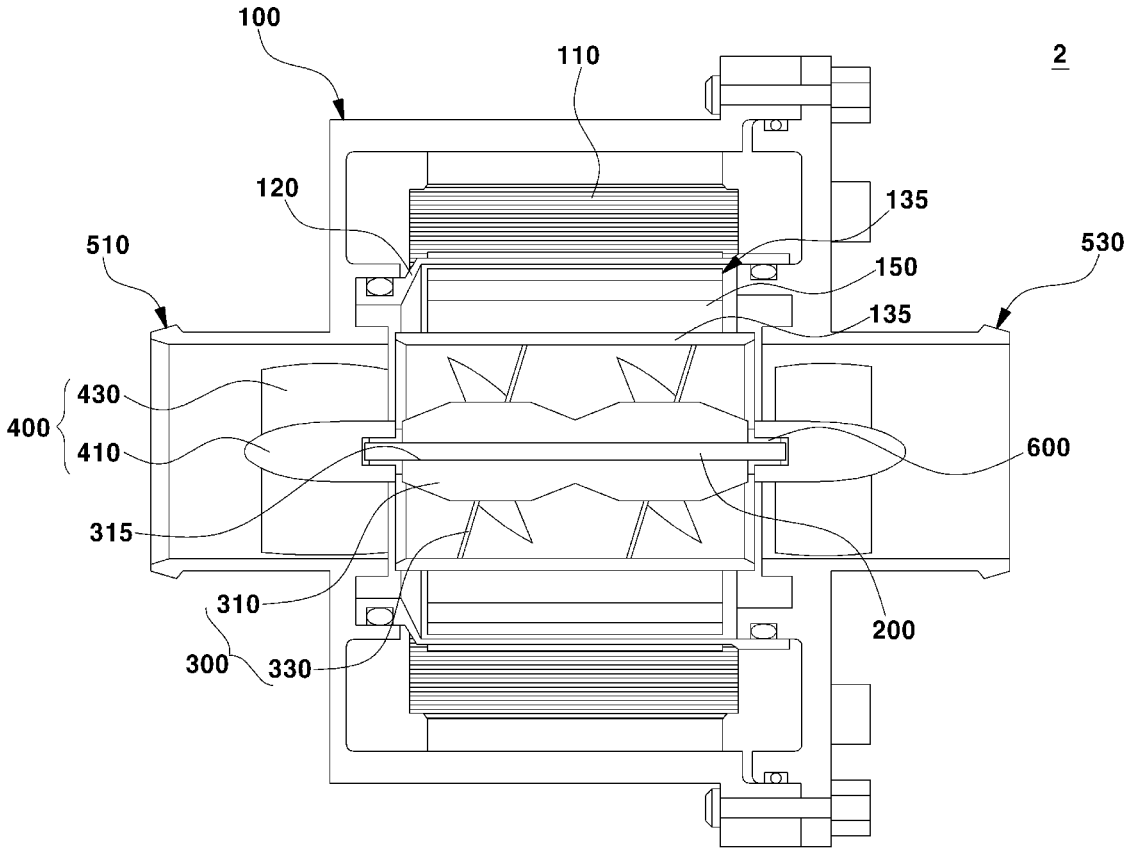

[FIG. 7]
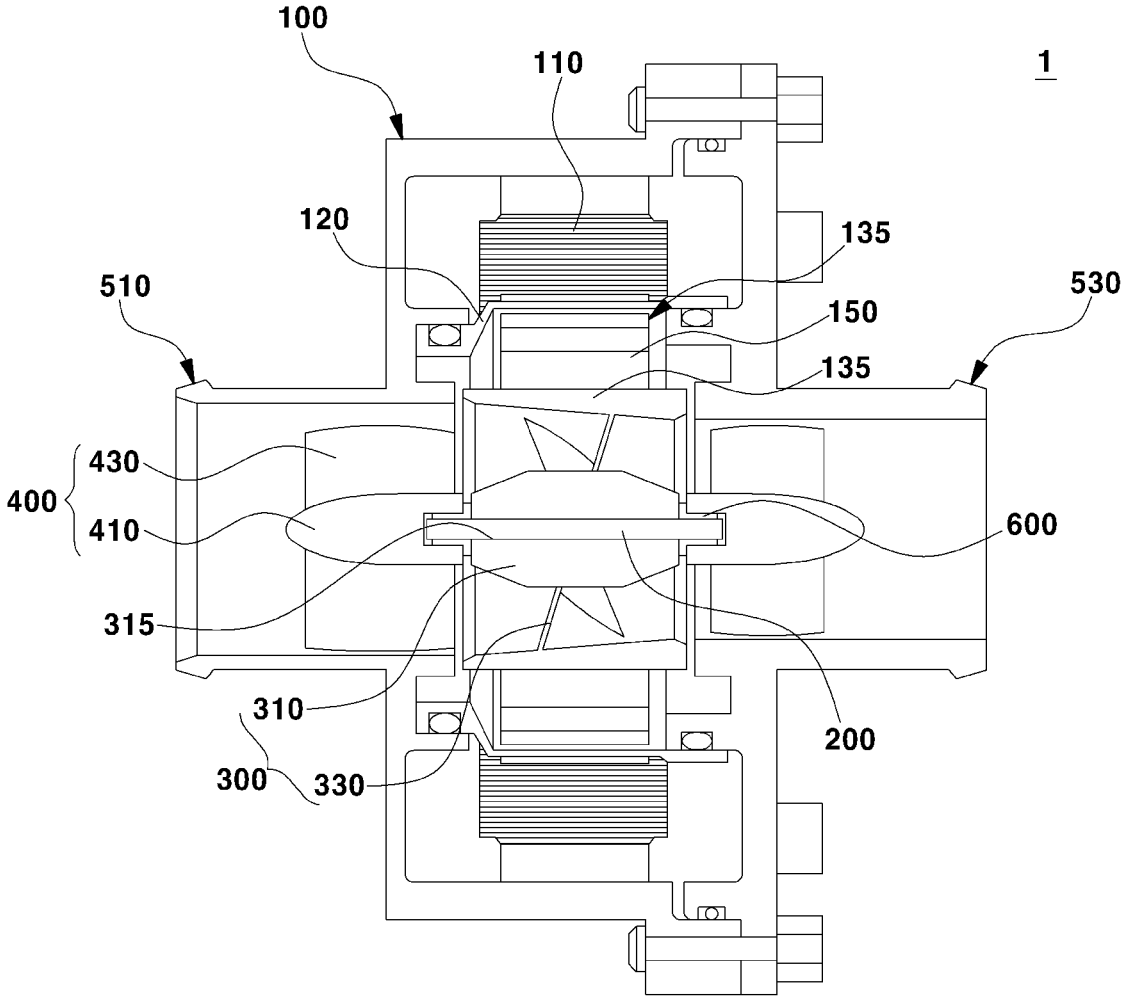

[FIG. 8]
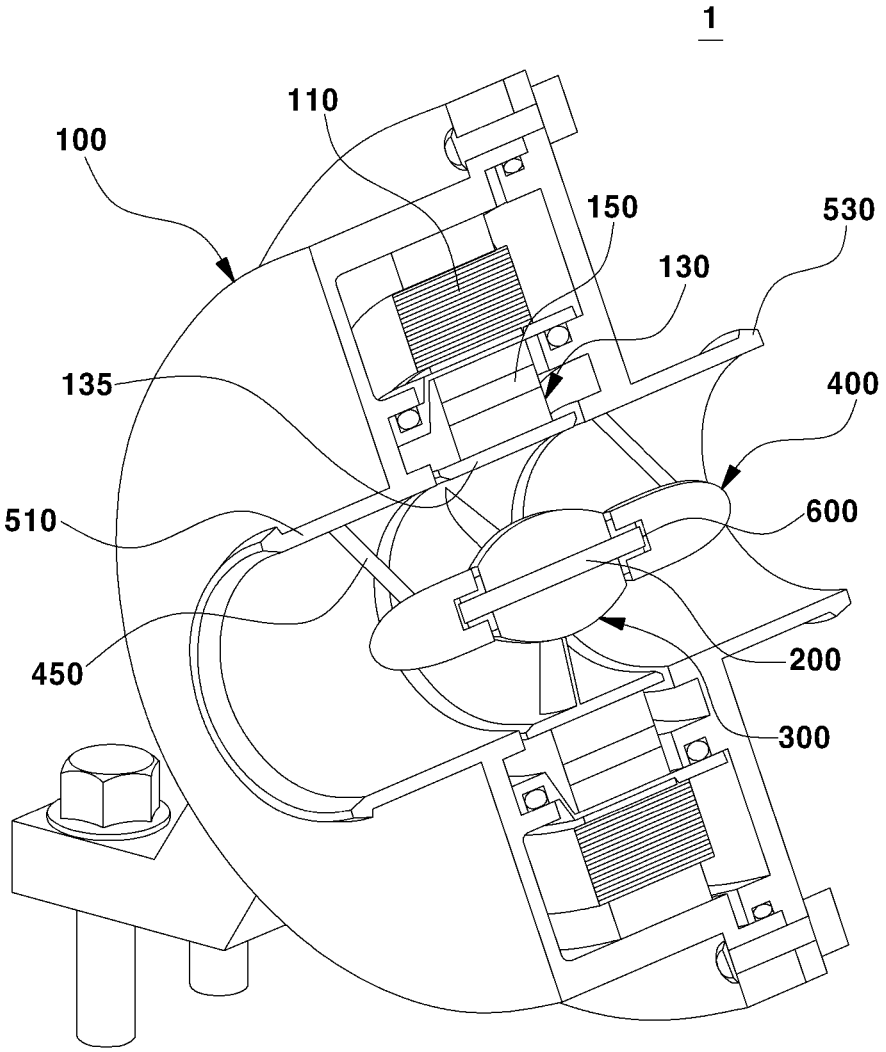

WATER PUMP WITH COOLANT FLOW PATH

CROSS REFERENCE TO RELATED APPLICATION

The present application claims priority to Korean Patent Application No. 10-2022-0087940, filed on Jul. 18, 2022, the entire contents of which is incorporated herein for all purposes by this reference.

TECHNICAL FIELD

The present disclosure relates to a water pump including a coolant flow path in which a coolant inflow path and a coolant outflow path are coaxially disposed.

BACKGROUND

A thermal management system of a fuel cell uses coolant to dissipate reaction heat generated during production of an electric current in the fuel cell, and is equipped with a pump that increases the coolant pressure by mechanical force for circulating the coolant. In general, the pump uses a centrifugal impeller, and such a centrifugal impeller structure-type pump is composed of a hydraulic section which is exposed to coolant, and a drive section which drives the hydraulic section. Since the components of the drive section may be corroded when exposed to the coolant, the drive section is separated from the hydraulic section so that the drive section is not exposed to the coolant. FIG. 1 illustrates a conventional water pump, in which a hydraulic section 10 and a drive section 20, which is composed of a stator 23 and a rotor 25, are separated from each other, wherein the drive section 20 is not exposed to the coolant. However, the pressure of the coolant is regulated by rotation of an impeller connected to a shaft 21 of the drive section 20.

However, in an impeller used in a conventional centrifugal pump, an inlet and an outlet are vertically arranged, and a straight pipe having a specified length or more needs to be secured in a pipe constituting the inlet and the outlet to improve the performance efficiency of the hydraulic section 10 and to configure a hose assembly. In addition, since the drive section 20 and the hydraulic section 10 are separated from each other such that the hydraulic section 10 is disposed on the front of the drive section in a coolant in flow direction, a lot of space is required in the installation of the pump to secure such the straight pipe. Accordingly, there is a problem that the configuration of the thermal management system including the pump is adversely affected.

SUMMARY

The present disclosure has been made in an effort to solve the above-described problem, and an objective of the present disclosure is directed to a water pump housing a coolant flow path along which coolant flows.

Another objective of the present disclosure is directed to a water pump including a coolant flow path capable of reducing load applied to a bearing supporting rotation of a rotor while preventing a vortex of coolant.

In an aspect of the present disclosure, a water pump with a coolant flow path is provided. The water pump includes: a stator disposed in a housing; a rotor surrounded by the stator, configured to receive a magnetic body, and defining a flow path; a shaft disposed in the flow path; a first blade connected to the shaft; a first pipe spaced apart from an inner wall of the rotor and extending in a direction in which the inner wall extends to define an inlet through which coolant flows; a second pipe spaced apart from the inner wall of the rotor and extending in a direction in which the inner wall extends to define an outlet through which the coolant flows; and a second blade connected to the shaft and disposed in the first pipe or the second pipe.

In some implementations, the first pipe and the second pipe may have a same diameter, and a center of each of the first pipe and the second pipe may be coaxial with the shaft.

In some implementations, an inner diameter of the second pipe may be smaller than an inner diameter of the first pipe.

In some implementations, an inner diameter of the rotor may decrease in a direction from the first pipe toward the second pipe, the inner diameter of the first pipe may be equal to an inner diameter of a first portion of the rotor, and the inner diameter of the second pipe may be equal to the inner diameter of a second portion of the rotor.

In some implementations, the second blade may define a recess configured to receive the shaft, and the shaft may be connected to the second blade through a bearing inserted in the recess.

In some implementations, the bearing may be an underwater bearing disposed in the flow path.

In some implementations, the second blade may be coupled to the first pipe and the second pipe, and the second blade may include a plurality of blade parts extending in a direction in which the shaft extends.

In some implementations, the shaft may be configured to rotate with respect to the second blade.

In some implementations, the first blade may define a through configured to receive the shaft.

In some implementations, the first blade may be disposed inside the flow path, and the first blade may be provided in plurality.

In some implementations, a plurality of sealing parts may be respectively provided at both ends of the magnetic body in the direction in which the shaft extends to seal a first gap between the inner wall of the rotor and the first pipe and a second gap between the inner wall of the rotor and the second pipe.

In some implementations, a sealing wall may be provided between the stator and the rotor to block an inflow of the coolant, and the sealing wall may be in contact with the housing so that the stator and the rotor are spatially separated by the sealing wall.

In some implementations, a sealing part may be disposed between the sealing wall and the housing.

In some implementations, the first pipe and the second pipe may be coupled to the housing.

In some implementations, the inner wall of the rotor defining the flow path may be spaced apart from the first pipe and the second pipe so that the coolant flows through a first gap between the first pipe and the inner wall and a second gap between the second pipe and the inner wall.

In some implementations, the second blade may be connected to at least one of the first pipe or the second pipe through a fixing member, and a position of the second blade may be fixed in the first pipe or the second pipe.

In some implementations, the first pipe defining the inlet and the second pipe defining the outlet are coaxially arranged, and the flow path connecting the inlet and the outlet is formed inside the rotor, so that the space required to configure a package of water pump may be reduced. In addition, since the first pipe and the second pipe are substantially parallel to each other, a separate hose assembly and related parts required for the arrangement of the straight pipe are eliminated, thereby reducing the overall weight of the package and the package configuration cost.

In some implementations, vortex generation due to an inflow of coolant can be prevented with the rectification action by the second blades disposed in front and rear of the first blade.

In some implementations, since a bearing can be applied to the shaft having a relatively small diameter and thus the size of the bearing itself can be reduced, the load applied to the bearing can be reduced.

In some implementations, the components for driving the water pump can be prevented from being exposed to the coolant by the sealing wall that prevents the stator from being exposed to the coolant.

In some implementations, the rotor can be cooled as the coolant flows through the flow path defined by the rotor, and the coolant can come into direct contact with the sealing wall that contacts and seals the stator, thereby improving cooling efficiency of the stator.

BRIEF DESCRIPTION OF THE DRAWINGS

FIG. 1 is a diagram illustrating a cross-sectional view of a conventional water pump.

FIG. 2 is a diagram illustrating a cross-sectional view of an example of a water pump including a coolant flow path.

FIG. 3 is a diagram illustrating a cutaway perspective view of an example of the water pump.

FIG. 4 is a diagram illustrating an enlarged view of section A of FIG. 2.

FIG. 5 is a diagram illustrating an example of a connection relationship between a shaft and a second blade.

FIG. 6 is a diagram illustrating a cross-sectional view of an example of a water pump including a coolant flow path.

FIG. 7 is a diagram illustrating a cross-sectional view of an example of a water pump including a coolant flow path.

FIG. 8 is a diagram illustrating a cutaway perspective view of an example of a water pump including a coolant flow path.

DETAILED DESCRIPTION

FIG. 2 is a diagram illustrating a cross-sectional view of an example of a water pump including a coolant flow path, and FIG. 3 is a diagram illustrating a cutaway perspective view of an example of the water pump.

Referring to FIGS. 2 and 3, the water pump 1 may include a stator 110, a rotor 130, a shaft 200, a first blade 300, and a second blade 400. The water pump 1 may be a component of a fuel cell thermal management system for cooling high-temperature coolant discharged from a fuel cell. The stator 110, the rotor 130, the shaft 200, the first blade 300, and the second blade 400 may be disposed in a housing 100. An inlet through which coolant is introduced and an outlet through which the coolant is discharged may be defined in the housing 100. The inlet may be defined by the first pipe 510, and the outlet may be defined by the second pipe 530. The first pipe 510 and the second pipe 530 may be a portion of the housing 100.

The stator 110 and the rotor 130 may generate a rotational force for regulating the pressure of coolant. The stator 110 and the rotor 130 may be disposed in the housing 100. The stator 110 may include a coil to which an electric current is applied, and the rotor 130 may include a magnetic body 150. The rotor 130 may be rotated by an electric current applied to the stator 110. The rotor 130 may include an inner wall 135 defining a flow path through which coolant flows, and the shaft 200 may be disposed in the flow path defined by the inner wall 135. The shaft 200 disposed in the rotor 130 may be rotated by the rotation of the rotor 130. The magnetic body 150 may maintain a contacted state with the inner wall 135 of the rotor 130, and the inner wall 135 may be connected to the first blade 300. By rotation of the rotor 130, the shaft 200 disposed in the flow path defined by the rotor 130 may be rotated with the rotor 130.

The shaft 200 may be disposed in the coolant flow path defined by the inner wall 135 of the rotor 130. The shaft 200 may extend in one direction, and the rotor 130 and the stator 110 may be disposed to overlap in a direction perpendicular to the direction in which the shaft 200 extends. In other words, the rotor 130 may be disposed on the outer side from the shaft 200, the stator 110 may be disposed on the outer side from the rotor 130, and the housing 100 may be disposed on the outer side from the stator 110.

The shaft 200 may be connected to the first blade 300 and the second blade 400. The first blade 300 may include a first body portion 310 and a first blade portion 330. A through hole 315 may be defined in the first body portion 310, and the shaft 200 may be inserted into the through hole 315 defined in the first body portion 310.

The first blade portion 330 may be provided in plurality so as to be connected to the first body portion 310. The first blade portion 330 may extend in an inclined direction with respect to the direction in which the shaft 200 extends. For example, the first blade 300 may be an axial-type blade. As the first blade portion 330 extends in an inclined direction, a fluid may be pressurized. In order to pressurize a fluid, an angle defined by both ends of the first blade portion 330 needs to be greater than 0 degrees and less than 90 degrees. One end of the first blade portion 330 may refer to an end toward the inlet through which coolant is introduced, and the other end of the first blade portion 330 may refer to an end toward the outlet through which coolant is discharged. Since the angle defined by the both ends of the first blade portion 330 being 0 degrees means that the first blade portion 330 blocks the flow path, the angle defined by the both ends of the first blade portion 330 cannot be 0 degrees. In addition, since the angle defined by the both ends of the first blade portion 330 being 90 degrees means that a fluid cannot be pressurized, the angle cannot defined by the both ends of the first blade portion 330 be 90 degrees. Accordingly, an angle defined by both ends of the first blade portion can be appropriately adjusted to pressurize a fluid. The first blade 300 may be rotated by the rotation of the shaft 200, and the pressure of coolant flowing through the flow path may be adjusted by the rotation of the first blade 300.

The second blade 400 may include a second body portion 410 and a second blade portion 430. The shaft 200 may be connected to the second blade 400 through the bearing 600. The bearings 600 may be disposed at both ends of the shaft 200, respectively. Specifically, the shaft 200 may be inserted into a recess defined in the second body portion 410, and the bearing 600 may be inserted into the recess to connect the second body portion 410 and the shaft 200. The second blade portion 430 may be provided in plurality such that the second blade portions extend in a direction in which the coolant flows or a direction in which the shaft 200 extends. That is, the second blade 400 may include the second blade portion 430 formed in a straight form instead of an inclined form to minimize a contact area with coolant while being less affected by a flow of coolant. The second blade 400 may function as a kind of rectifying plate. The shapes of the first blade portion 330 and the second blade portion 430 constituting the first blade 300 and the second blade 400, respectively, may be different from each other. The different shapes of the first blade portion 330 and the second blade portion 430 are provided such that the coolant is pressure-adjusted through the first blade 300, and the coolant is rectified through the second blade 400.

The first blade 300 may be disposed in a flow path defined by the inner wall 135 of the rotor 130. The second blades 400 may be disposed in the first pipe 510 and the second pipe 530, respectively. The first blade 300 may be rotated by the rotation of the rotor 130 to adjust the pressure of coolant. The second blades 400 may be coupled to the first pipe 510 and the second pipe 530, respectively. That is, the first blade and the second blade may be configured such that two second blades 400 are fixed and the first blade 300 rotates with respect to the two fixed second blades 400. At this time, since the bearing 600 supporting the rotating first blade 300 is disposed in the flow path through which coolant flows, the load applied to the bearing 600 may be lowered. In addition, since the bearing 600 of which temperature increases with friction is disposed in the flow path through which coolant flows, the bearing 600 may be naturally cooled. For example, the bearing 600 may be an underwater bearing that may be applied to an apparatus operated in water, or a thrust bearing.

The first pipe 510 may define an inlet through which the coolant is introduced. The first pipe 510 may be spaced apart from the inner wall 135 of the rotor 130 defining the flow path, and may extend in a direction in which the inner wall 135 extends. The second pipe 530 may define an outlet through which the coolant is discharged. The second pipe 530 may be spaced apart from the inner wall 135 of the rotor 130 defining the flow path, and may extend in a direction in which the inner wall 135 extends. Since the rotor 130 is a rotatable element, the rotor may be spaced apart from the first pipe 510 and the second pipe 530. The first pipe 510 and the second pipe 530 may have the same diameter. In addition, the diameter of the first pipe 510 and the second pipe 530 may be the same as the diameter of the inner wall 135 of the rotor 130. That is, the diameter of the flow path may be the same as the diameter of the first pipe 510 and the second pipe 530. Since the diameters of the flow path, the first pipe 510, and the second pipe 530 are the same, the linear velocity of the coolant is identical in the whole range of sections. Accordingly, the pressure of coolant may be determined depending on the rotational speed of the first blade 300.

The centers of the first pipe 510 and the second pipe 530 may be coaxial with the shaft 200 or a rotational axis of the rotor 130. The second blades 400 may be coupled to the first pipe 510 and the second pipe 530, respectively. The shaft 200 may be disposed in the flow path defined by the inner wall 135 of the rotor 130 to extend toward each of the first pipe 510 and the second pipe 530. The shaft 200 extending into the first pipe 510 and the second pipe 530 may be connected to the second blades 400 coupled to each of the first pipe 510 and the second pipe 530.

The first pipe 510 and the second pipe 530 are coaxially configured so that the coolant flows through the flow path defined by the inner wall 135 of the rotor 130, the first pipe 510, and the second pipe 530 along a substantially straight flow path.

A sealing wall 120 may be provided between the stator 110 and the rotor 130 to prevent an inflow of coolant. The sealing wall 120 may be disposed to surround the outer side of the rotor 130. The sealing wall 120 may be connected to the inner wall of the housing 100, and the stator 110 and the rotor 130 may be spatially separated by the sealing wall 120. The sealing wall 120 may serve to prevent the coolant that may be introduced into the gaps between the inner wall 135 of the rotor 130 and the first and second pipes 510 and 530 from coming into contact with the stator 110.

In some implementations, the first pipe 510 defining the inlet and the second pipe 530 defining the outlet are coaxially arranged, and the flow path connecting the inlet and the outlet is formed inside the rotor 130, so that the space required to configure a package of water pump 1 may be reduced. In addition, since the first pipe 510 and the second pipe 530 are substantially parallel to each other, a separate hose assembly and related parts required for the arrangement of the straight pipe are eliminated, thereby reducing the overall weight of the package and the package configuration cost.

In some implementations, vortex generation due to an inflow of coolant can be prevented with the rectification action by the second blades 400 disposed in front and rear of the first blade 300.

The bearing 600 for supporting the rotation of a rotating body is subjected to higher load as the diameter of the rotating body increases. In some implementations, since the bearing 600 can be applied to the shaft 200 having a relatively small diameter and thus the size of the bearing 600 itself can be reduced, the load applied to the bearing 600 can be reduced.

In some implementations, the rotor can be cooled as the coolant flows through the flow path defined by the rotor, and the coolant can come into direct contact with the sealing wall that contacts and seals the stator, thereby improving cooling efficiency of the stator.

FIG. 4 is an enlarged view of section A of FIG. 2.

Referring to FIGS. 2 and 4, the sealing wall 120 may be connected to the inner surface of the housing 100. The sealing wall 120 may spatially separate the stator 110 and the rotor 130 from each other. In addition, the space in which the stator 110 is disposed may be sealed by the sealing wall 120. The sealing wall 120 may serve to prevent the stator 110 from being exposed to the coolant.

A first gap 51 may be defined between the inner wall 135 and the first pipe 510 of the rotor 130, and a second gap 53 may be defined between the inner wall 135 and the second pipe 530 of the rotor 130. Coolant may be introduced through the first gap 51 and the second gap 53 to cool the stator 110 and the rotor 130. However, the coolant may not come into direct contact with the stator 110 due to the sealing wall 120. Since the sealing wall 120 in direct contact with the stator 110 comes into contact with the coolant, the stator 110 may be indirectly cooled.

The sealing wall 120 may come into contact with the housing 100. The housing 100 may include extension portions 101 and 103 extending toward the stator 110 and the rotor 130. For example, the extension portions 101 and 103 may consist of a first extension portion 101 and a second extension portion 103, which are configured to extend toward the sealing wall 120 disposed between the stator 110 and the rotor 130. Each of the first extension portion 101 and the second extension portion 103 may be in contact with the sealing wall 120, and sealing parts 700 may be disposed between each of the first extension portion 101 and the second extension portion 103 and the sealing wall 120. That is, the sealing parts 700 may be disposed between the housing 100 and the sealing wall 120 for preventing an inflow of coolant. For example, the sealing part 700 may be formed with an O-ring, for example, which is made of an elastic material.

FIG. 5 is a diagram illustrating an example of a connection relationship between a shaft and a second blade.

Referring to FIGS. 2 and 5, a recess 405 may be defined in the second blade 400. The recess 405 may be defined in the second body portion 410 of the second blade 400 such that one end of the recess 405 is opened so that the shaft 200 may be inserted and the other end of the recess 405 may be blocked. The shaft 200 may be inserted into the recess 405 defined in the second blade 400. A bearing 600 may be disposed within the recess 405. In other words, the bearings 600 may be disposed at both ends of the shaft 200, wherein the both ends of the shaft 200 on which the bearing 600 is disposed may be placed into the recess 405 in the two second blades 400. Since the second blades 400 are coupled to the first and second pipes 510 and 530, the shaft 200 may rotate relative to the second blades 400. The first blade 300 is rotated by the rotation of the shaft 200 to adjust the pressure of the coolant.

In some implementations, the shaft 200 may be rotated by the rotation of the rotor 130, and the bearings 600 for supporting the rotation may be arranged on both ends of the shaft 200, which is disposed inside the flow path rather than outside the flow path or the rotor 130, so that the size of the bearing 600 may be reduced. As the size of the bearing 600 decreases, load applied to the bearing 600 may be reduced, thereby improving the durability of the water pump 1 itself.

FIG. 6 is a diagram illustrating a cross-sectional view of an example of a water pump including a coolant flow path. For brevity of description, a description of contents overlapping those of FIG. 2 will be omitted.

Referring to FIG. 6, the performance of the water pump 2 may be determined by the rotational speed of the first blade 300. In order to improve the performance of the water pump 2, a plurality of first blades 300 may be provided. A plurality of first blades 300 may be disposed in a flow path defined by the inner wall 135 of the rotor 130. In the present disclosure, since the first pipe 510 and the second pipe 530, through which coolant is introduced and discharged, have the same diameter, and are coaxially arranged with each other, the coolant pressure may be determined by the operation of the first blade 300. In order to increase a flow rate and pressure of coolant with rotation of the first blade 300, in addition to the rotational speed of the first blade 300, the number of the first blades 300 may be increased. Even if the number of the first blades 300 increases, the number of parts constituting the water pump 2 may stay the same.

FIG. 7 is a diagram illustrating a cross-sectional view of an example of a water pump including a coolant flow path. For brevity of description, a description of overlapping contents is omitted.

Referring to FIG. 7, a first pipe 510 defining an inlet through which coolant is introduced and a second pipe 530 defining an outlet through which coolant is discharged may be coupled to a housing 100. The first pipe 510 and the second pipe 530 may be a portion of the housing 100. The first pipe 510 and the second pipe 530 may be spaced apart from an inner wall 135 of a rotor 130 defining a flow path and may extend in a direction in which the inner wall extends. Since a rotor 130 is a rotatable element, the rotor may be spaced apart from the first pipe 510 and the second pipe 530.

The inner wall 135 of the rotor 130 may be tapered. Specifically, the diameter of the flow path defined by the inner wall 135 may gradually decrease in a direction from the first pipe 510 to the second pipe 530. Diameters of inner surfaces of the first pipe 510 and the second pipe 530 may correspond to the inner wall 135 of the rotor 130. The diameter of the inner surface of the first pipe 510 may be the same as the diameter of the adjacent inner wall 135. That is, the inner diameter of the first pipe may be equal to the inner diameter of a first portion of the rotor 130. The diameter of the inner surface of the second pipe 530 may be the same as the diameter of the adjacent inner wall 135. That is, the inner diameter of the second pipe may be equal to the inner diameter of a second portion of the rotor 130. Accordingly, the diameter of the inner surface of the second pipe 530 may be smaller than the diameter of the inner surface of the first pipe 510.

In some implementations, when the inner diameter of the second pipe 530 is smaller than the inner diameter of the first pipe 510, there is the effect that the coolant flowing through the flow path is compressed, which improves compression efficiency of the coolant. Accordingly, the problem that it is difficult for the water pump 1 to increase the coolant pressure to a required pressure due to the bulk size in volume of the water pump can be solved.

FIG. 8 is a diagram illustrating a cutaway perspective view of an example of a water pump including a coolant flow path. For brevity of description, a description of overlapping contents is omitted.

Referring to FIG. 8, a first blade 300 may be disposed in a flow path defined by an inner wall 135 of a rotor 130. Second blades 400 may be disposed in a first pipe 510 and a second pipe 530, respectively. The second blades 400 may be coupled to the first pipe 510 and the second pipe 530, respectively. The second blades 400 may be connected to the first pipe 510 and the second pipe 530 by a fixing member 450. In other words, the two second blades 400 connected to the first blade 300 may be connected to the first pipe 510 and the second pipe 530 by the fixing member 450. Accordingly, the second blades 400 may serve to fix the rotating first blade 300 in the flow path defined by the rotor 130.

What is claimed is:

1. A water pump comprising:

a housing;

a stator disposed in the housing;

a rotor surrounded by the stator, configured to receive a magnetic body, and defining a flow path;

a shaft disposed in the flow path;

a first blade connected to the shaft;

a first pipe spaced apart from an inner wall of the rotor and extending in a direction in which the inner wall extends to define an inlet through which coolant flows;

a second pipe spaced apart from the inner wall of the rotor and extending in a direction in which the inner wall extends to define an outlet through which the coolant flows; and a second blade connected to the shaft and disposed in the first pipe or the second pipe.

2. The water pump of claim 1, wherein the first pipe and the second pipe have a same diameter, and a center of each of the first pipe and the second pipe is coaxial with the shaft.

3. The water pump of claim 1, wherein an inner diameter of the second pipe is smaller than an inner diameter of the first pipe.

4. The water pump of claim 3, wherein:

an inner diameter of the rotor decreases in a direction from the first pipe toward the second pipe, the inner diameter of the first pipe is equal to an inner diameter of a first portion of the rotor, the inner diameter of the second pipe is equal to the inner diameter of a second portion of the rotor.

5. The water pump of claim 1, wherein the second blade defines a recess configured to receive the shaft, and wherein the shaft is connected to the second blade through a bearing inserted in the recess.

6. The water pump of claim 5, wherein the bearing is an underwater bearing disposed in the flow path.

7. The water pump of claim 6, wherein the second blade is coupled to the first pipe and the second pipe, and the second blade includes a plurality of blade parts extending in a direction in which the shaft extends.

8. The water pump of claim 7, wherein the shaft is configured to rotate with respect to the second blade.

9. The water pump of claim 1, wherein the first blade defines a through hole configured to receive the shaft.

10. The water pump of claim 1, wherein the first blade is disposed inside the flow path, and the first blade is provided in plurality.

11. The water pump of claim 1, further comprising a plurality of sealing parts that are respectively provided at both ends of the magnetic body in the direction in which the shaft extends and that seal a first gap between the inner wall of the rotor and the first pipe and a second gap between the inner wall of the rotor and the second pipe.

12. The water pump of claim 1, further comprising a sealing wall disposed between the stator and the rotor, configured to block an inflow of the coolant, and contacting the housing to separate the stator from the rotor.

13. The water pump of claim 12, further comprising a sealing part disposed between the sealing wall and the housing.

14. The water pump of claim 1, wherein the first pipe and the second pipe are coupled to the housing.

15. The water pump of claim 1, wherein the inner wall of the rotor defining the flow path is spaced apart from the first pipe and the second pipe so that the coolant flows through a first gap between the first pipe and the inner wall and a second gap between the second pipe and the inner wall.

16. The water pump of claim 1, wherein the second blade is connected to at least one of the first pipe or the second pipe through a fixing member, and a position of the second blade is fixed in the first pipe or the second pipe.

* * * * *